US006883654B2

(12) United States Patent
Godshaw et al.

(10) Patent No.: US 6,883,654 B2
(45) Date of Patent: Apr. 26, 2005

(54) LUGGAGE WITH COVER

(75) Inventors: Donald E. Godshaw, Evanston, IL (US); Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 173 days.

(21) Appl. No.: 10/395,542

(22) Filed: Mar. 24, 2003

(65) Prior Publication Data

US 2004/0007434 A1 Jan. 15, 2004

Related U.S. Application Data

(63) Continuation of application No. 10/191,196, filed on Jul. 9, 2002.

(51) Int. Cl.[7] ..... A45C 13/26

(52) U.S. Cl. ..... 190/115; 190/113; 190/107; 190/110

(58) Field of Search ..... 190/107, 108, 190/109, 110, 113, 115, 18 A; 383/37

(56) References Cited

U.S. PATENT DOCUMENTS

| | | | | |
|---|---|---|---|---|
| 1,947,718 | A | * | 2/1934 | LaBadie et al. ..... 190/115 X |
| 3,023,867 | A | | 3/1962 | Kotkins |
| 3,512,621 | A | | 5/1970 | Teetor |
| 3,777,862 | A | | 12/1973 | Zipper |
| 3,944,032 | A | | 3/1976 | Samhammer et al. |
| D242,658 | S | | 12/1976 | Genaro et al. |
| 4,059,464 | A | | 11/1977 | Geller et al. |
| 4,854,431 | A | * | 8/1989 | Pulichino, Jr. et al. . 190/110 X |
| 4,854,432 | A | | 8/1989 | Carpenter et al. |
| 5,108,119 | A | * | 4/1992 | Huang ..... 190/18 A X |
| 5,435,423 | A | * | 7/1995 | Rekuc et al. ..... 190/115 X |
| D367,359 | S | | 2/1996 | Smith |
| 5,515,954 | A | * | 5/1996 | Nordstrom ..... 190/115 X |
| 5,566,797 | A | * | 10/1996 | Van Himbeeck ..... 190/18 A |
| 6,000,509 | A | | 12/1999 | Chisholm |
| 6,196,718 | B1 | | 3/2001 | Dechant |
| 6,276,501 | B1 | * | 8/2001 | Tong ..... 190/113 X |
| 6,296,094 | B1 | * | 10/2001 | Knecht ..... 190/107 |
| 6,334,519 | B1 | * | 1/2002 | Tong ..... 190/107 |
| 6,467,594 | B1 | * | 10/2002 | Wu ..... 190/115 X |
| 2002/0074199 | A1 | * | 6/2002 | Albritton ..... 190/107 |
| 2003/0042160 | A1 | | 3/2003 | Godshaw et al. |

* cited by examiner

*Primary Examiner*—Tri M. Mai
(74) *Attorney, Agent, or Firm*—Banner & Witcoff, Ltd.

(57) ABSTRACT

Travel luggage includes a reinforced bottom panel and opposite end panels with a telescoping handle and wheels attached to the bottom panel and arranged to stiffen the end panels to provide for a semi-rigid configuration of the luggage. The luggage further includes a flexible fold over flap that folds over the contents of the luggage and is connected by a single fastening mechanism extending from the back panel of the luggage along the side panels and front panel. The cover flap includes interior pouches or other storage features which may be removable from the fold over cover or flap.

7 Claims, 4 Drawing Sheets

FIG. 1
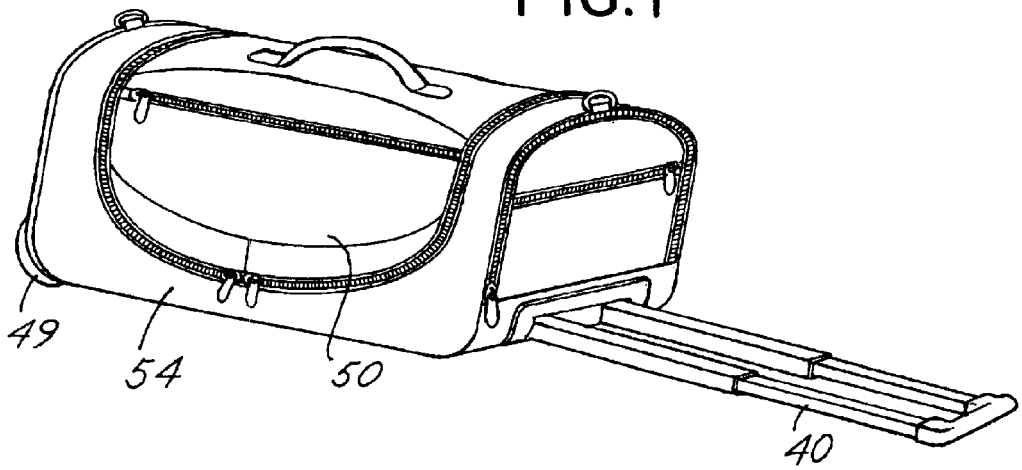
FIG. 2
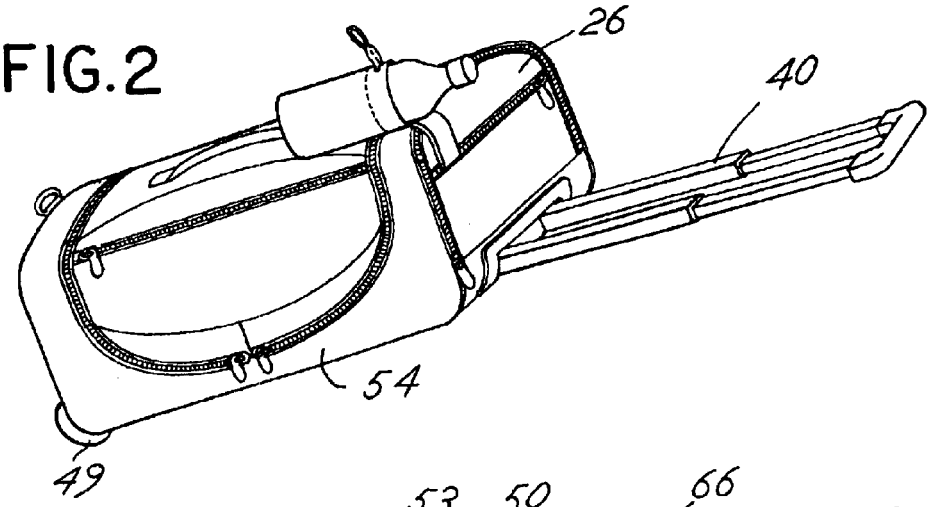
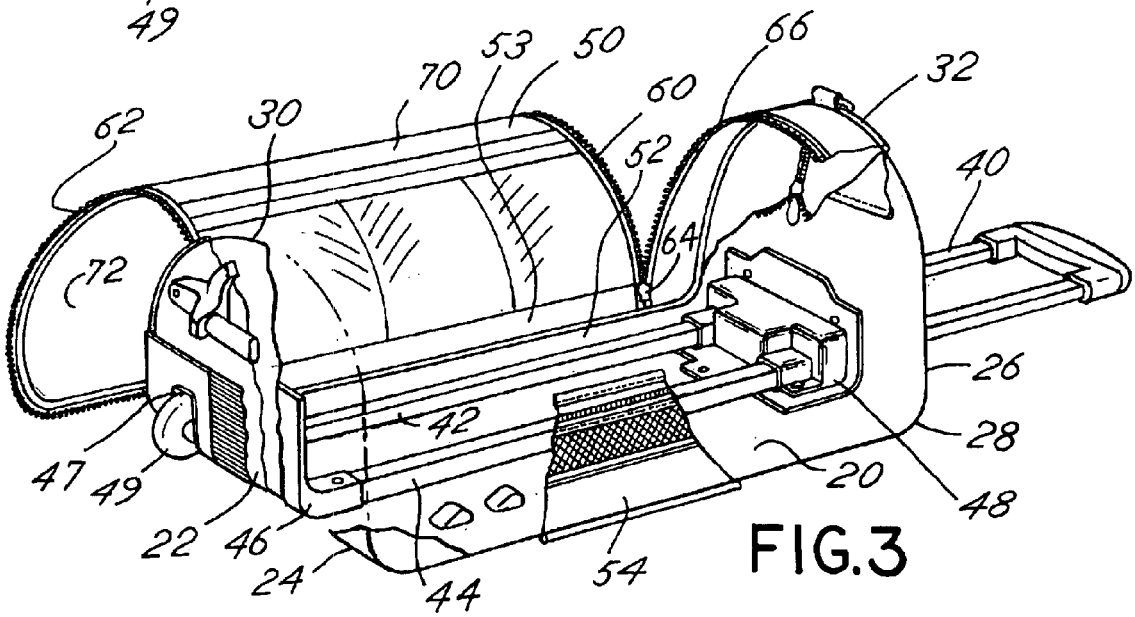
FIG. 3

FIG. 4
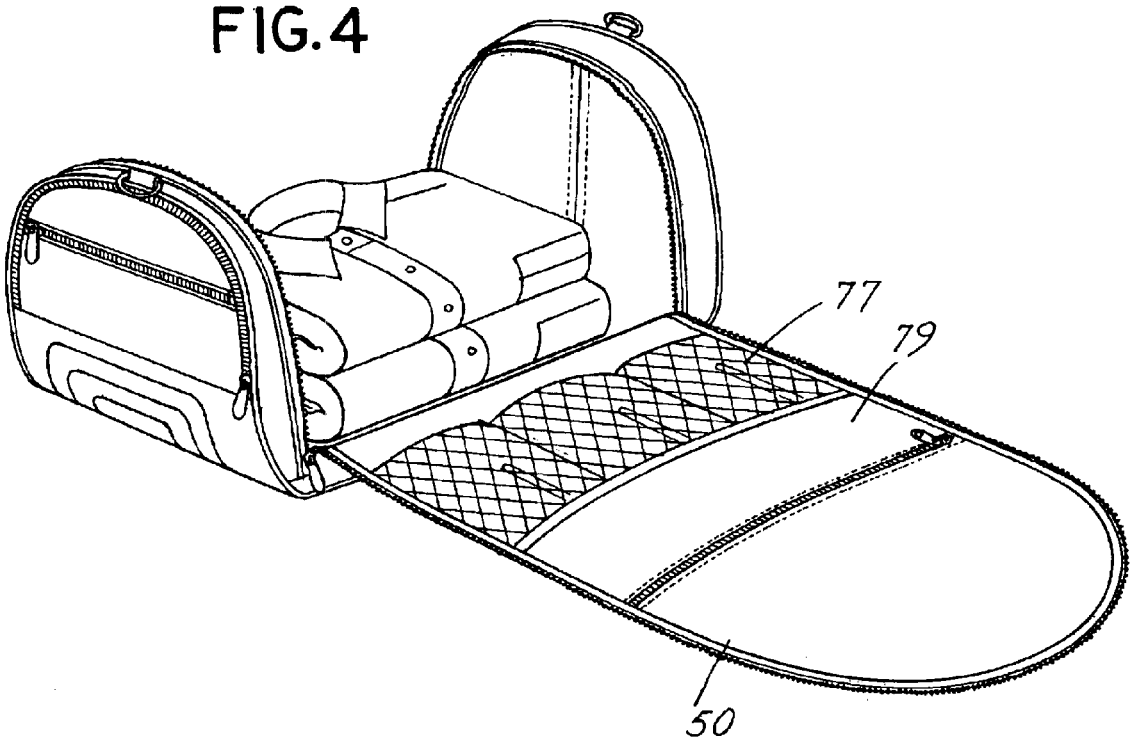
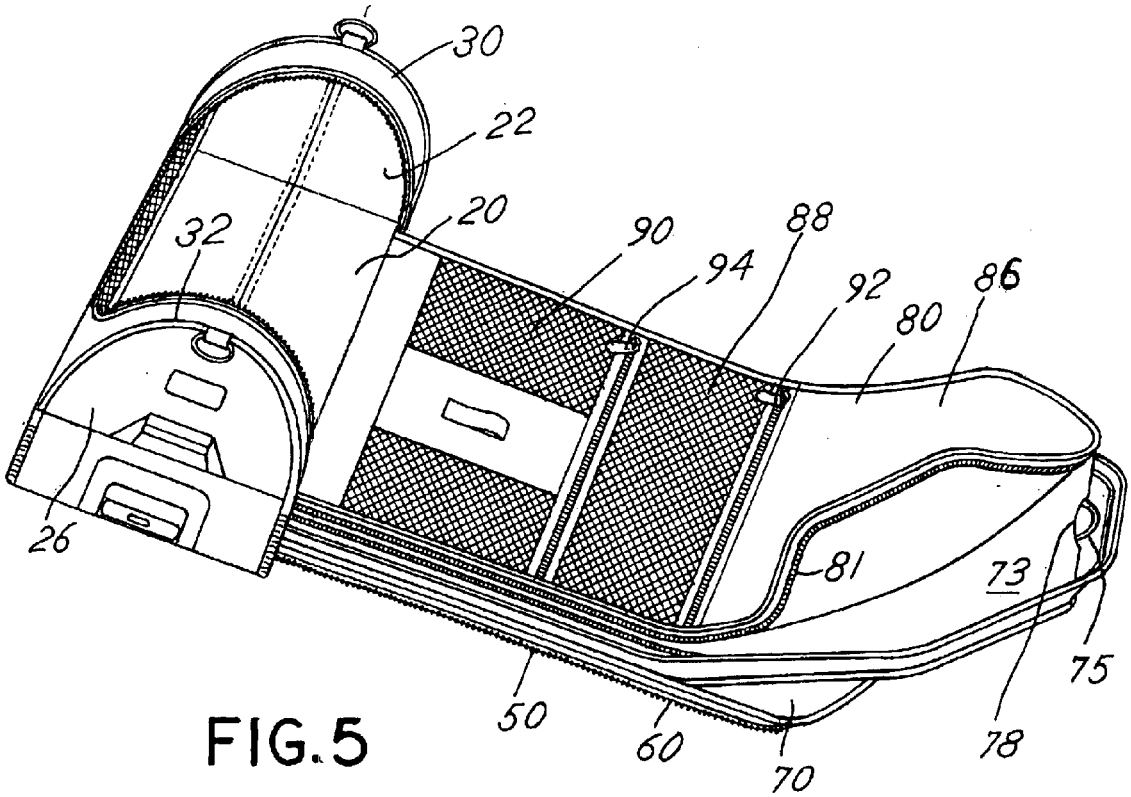
FIG. 5

FIG. 8
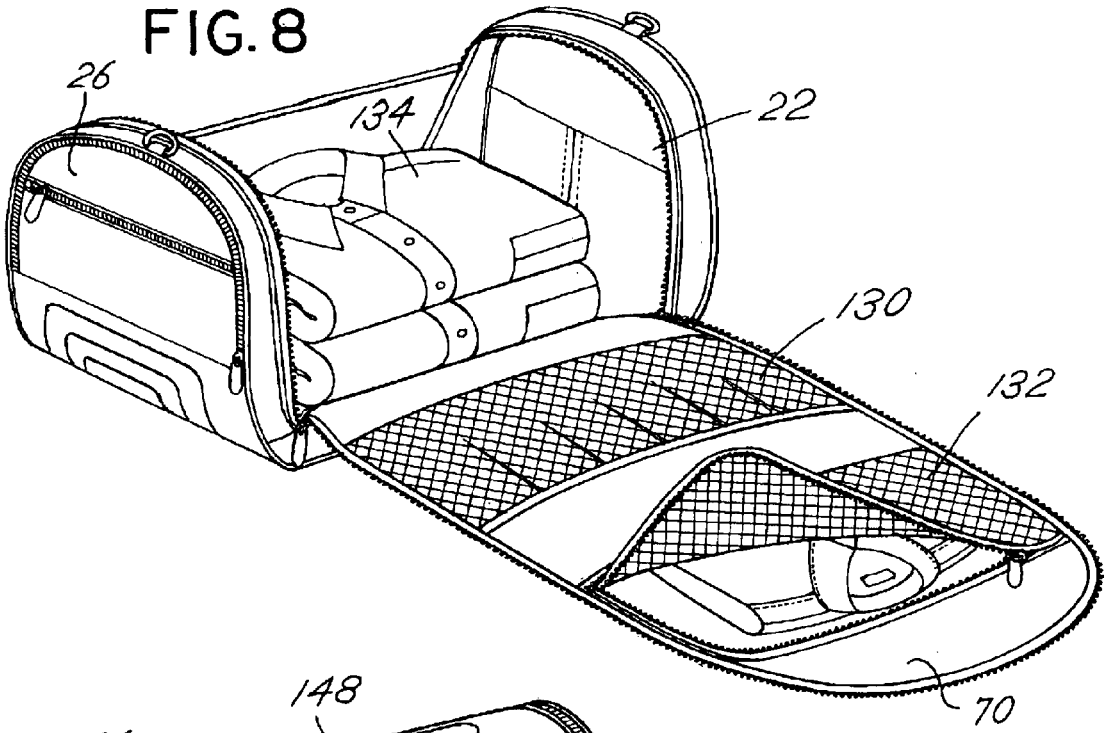
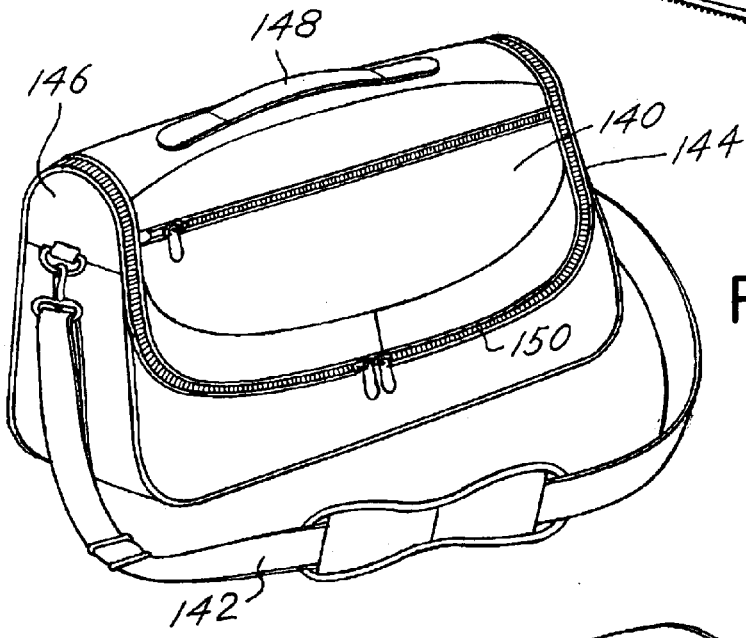
FIG.9
FIG.10
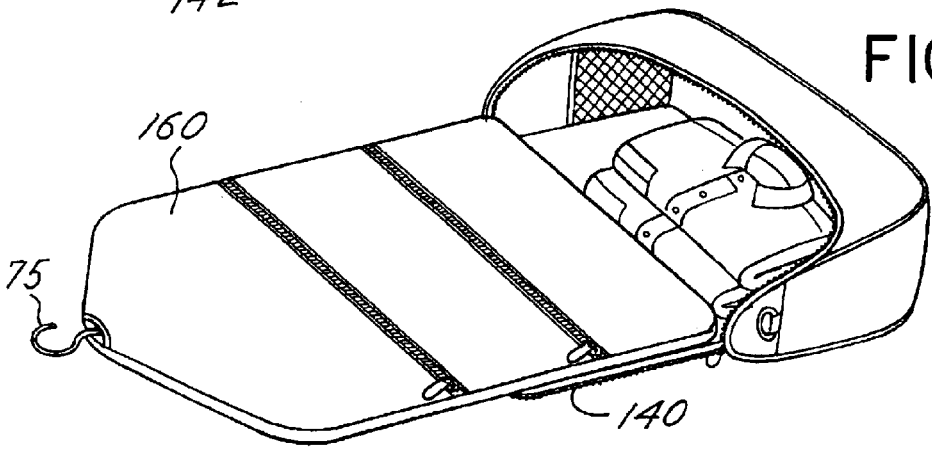

LUGGAGE WITH COVER

CROSS REFERENCE TO RELATED APPLICATION

This is a continuation application based on U.S. Utility application Ser. No. 10/191,196 filed Jul. 9, 2002, which is incorporated herewith by reference.

BACKGROUND OF THE INVENTION

In a principal aspect, the present invention relates to an item of luggage which includes a telescoping handle, wheels, and a fold over top flap or cover having a wardrobe or storage pouch on the inside of the flap or cover.

Travel luggage is often cumbersome and difficult not only to pack, but to move or transport from place to place. Numerous designs of travel luggage have been proposed and manufactured, and are available in the marketplace. Often it is desirable to have soft-sided travel luggage inasmuch as soft-sided luggage provides the user with greater flexibility when packing the luggage. Additionally, it is desirable to have a means or mechanism to facilitate transportation of the luggage such as a telescoping carrier handle and wheels. It is also desirable to provide luggage of this nature the option of movement by being carried by a shoulder strap or by luggage handles. Further, it is desirable to have luggage that is attractive, lightweight, rugged, and which may provide an interior packing space that will not be crushed or adversely impacted when the luggage is closed and packed. Another desire for such items is to provide luggage of a size which can be carried on aircraft for air travel and will fit under an airline seat or in an overhead storage bin.

Characteristics in luggage of the type described constituted an incentive to design the luggage of the invention.

SUMMARY OF THE INVENTION

Briefly, the present invention comprises luggage which includes a generally rectangular, bottom panel and opposite, and upstanding end panels, all of which are attached together and maintained in a fixed configuration by means of stiffening members or reinforcing members formed as part of the end panels and bottom panel. The bottom panel may be stiffened, for example, by means of a telescoping handle assembly attached to the bottom panel. The bottom panel thus includes attached opposite and upstanding end panels which, in turn, are stiffened by extensions of the bottom panel attached to the housing for the telescoping handle.

The luggage further includes an integral soft-sided, partial front panel and an integral soft-sided, partial back panel with a soft-sided, top cover flap that extends from a hinged connection to the back panel over the top of the luggage item and downwardly to connect to the integral front panel thereby defining an enclosure. The top cover flap provides a portion of the back side panel as well as the top side of the luggage and a portion of the front side panel.

The fold over top flap or cover further includes pouches, pockets, a wardrobe, or a hanging bag on the inside face of the top flap. The pouches, garment carrier or hanging bag may be removable from the inside face of the top flap in some cases and may be permanently attached in other cases. In the event that a wardrobe, garment or hanging bag is included on the inside face of the top flap, the bag may extend beyond the top edge of the flap or cover. Then it will be folded over on the inside face of the top flap when the top flap is moved to the closed position. Additionally, in the event that the wardrobe, garment or hanging bag is included on the inside face of the top flap, then a zipper connection may be provided for access to the interior of the bag.

The hanging bag will typically include an upper margin with a hanger opening therethrough. A cover sheet for the hanging bag will then include a zipper which is a continuous single zipper that closes the cover sheet and fits the cover sheet to the interior of the hanging bag.

Numerous alternative constructions for the hanging bag, pouches and for wardrobes and the like may be substituted or included on the inside face or inside of the top flap or cover. In each, however, the top flap or cover is closed or fastened to the luggage by a single continuous zipper or fastening mechanism extending along the margin or connection between the top flap and the end panels and the integral front panel of the luggage item. This single connection construction (e.g. zipper) ensures that the top flap or cover will be supported above the interior space of the luggage between the closed top flap and the bottom panel or wall thus insuring that a storage space will be maintained within the interior of the luggage while at the same time insuring that the pouch or hanging bag on the inside of the top flap will maintain the contents in a desired condition. Handles may be provided on the outside of the end panels or on the outside of the top flap or cover. A shoulder carrying strap may be attached to the outside of the opposite end panels.

Thus it is an object of the invention to provide a luggage item which incorporates a telescoping handle, wheels and a fold over top flap cover which ensures maintenance of a space for items within the interior of the luggage when the top flap cover is attached or closed.

Yet another object of the invention is to provide luggage which is rugged, inexpensive, lightweight, and capable of being designed to incorporate any one of a number of alternative pouch and hanging bag constructions on the inside of a top flap cover.

Yet another object of the invention is to provide a luggage item which includes a fold over top flap cover attached to end panels and a front panel of the luggage by means of single zipper type or other closure construction.

These and other objects, advantages and features of the invention will be set forth in the detailed description which follows.

BRIEF DESCRIPTION OF THE DRAWING

In the detailed description which follows reference will be made to the drawing comprised of the following figures:

FIG. 1 is an isometric view of a first embodiment of the luggage item of the invention in the form of a duffel-type bag including wheels, a telescoping handle;

FIG. 2 is another isometric view of the bag shown in FIG. 1;

FIG. 3 is an isometric view of the embodiment of FIG. 1 wherein the interior of the luggage or bag is depicted in a cut-away isometric view;

FIG. 4 is an isometric view of the embodiment of FIG. 1 wherein the top flap cover is in the open position;

FIG. 5 is an isometric view of the embodiment of FIG. 4 wherein the cover of the hanging bag is depicted as being partially open;

FIG. 8 is an isometric view of yet another embodiment of the invention in the open position;

FIG. 9 is an isometric view of an alternative embodiment designated as a tote or carry bag embodiment; and FIG. 10 is isometric view of the embodiment of FIG. 9 wherein the tote construction is in the open position.

DESCRIPTION OF THE PREFERRED EMBODIMENTS

Figure 6:
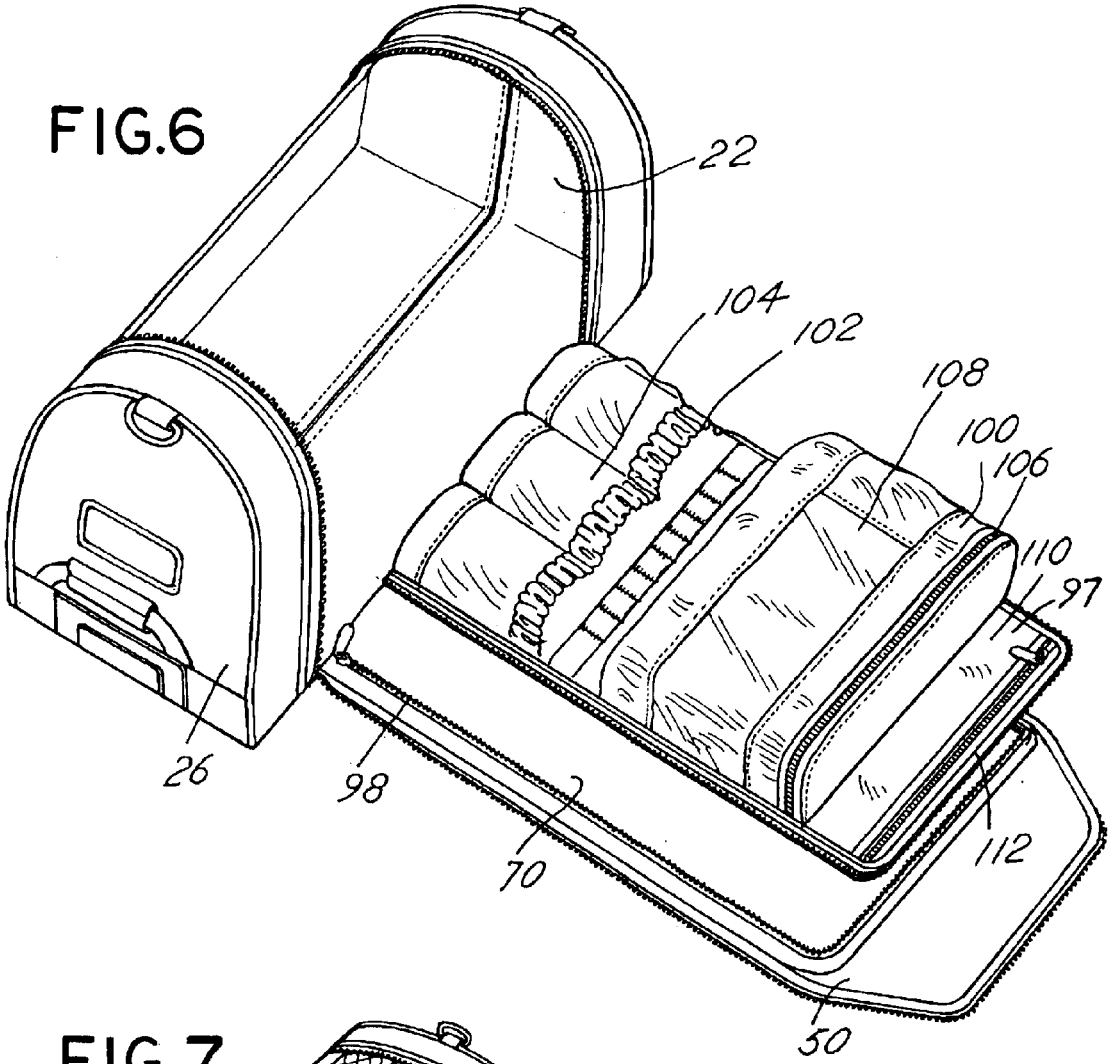
FIG. 6 is an isometric view of an alternative embodiment of the invention.

FIGS. 1–5 illustrate a first embodiment of the invention. Referring to those figures, the embodiment is generally termed a duffel bag embodiment inasmuch as the top side or panel, front side or panel, and back side or panel are generally soft-sided. However, the bottom and end panels (as described below) are generally rigid or semi-rigid having a U-shaped configuration or profile in combination with a telescoping handle that facilitates maintaining the U-shaped configuration.

Thus, a generally rectangular bottom side or panel 20 includes a rigid or semi-rigid reinforcing board or panel such as a polyethylene or polypropylene board or panel encased or positioned between layers or on a layer of fabric. The bottom panel 20 includes a first lateral edge 24 connected with and serving as the juncture with a first end panel 22 that projects generally upwardly in a perpendicular direction from the bottom panel 20. A second end panel 26 is positioned at the opposite end of the bottom panel 20 and extends upwardly from a juncture 28 therewith. The first end panel 22 and second end panel 26 are each generally rigid or semi-rigid and project in a perpendicular direction upwardly from the bottom panel 20. The first end panel 22 and second end panel 26 are congruent and thus substantially identical in size and shape. The first and second end panels 22, 26 define straight line junctures or lower edges 24 and 28, respectively. Each end panel 22, 26 has a uniform width that extends upwardly for a limited distance from bottom panel 20 and each terminates with an upper arcuate section 82. Each end panel 22, 26 further includes an inwardly extending, arcuate top margin 30 and 32, respectively.

Referring again to FIG. 3, the margins 30 and 32 associated with the end panels 22 and 26, respectively, extend inwardly toward one another from the opposite ends of the luggage container or bag. The margins 30 and 32 are curved, top side panels and extend from an integral back panel 52 to an integral front panel 54. The integral back panel 52 extends partially upwardly from the bottom panel 20 as does the integral front panel 54. Preferably, the integral back panel 52 and the integral front panel 54 extend upwardly from the bottom panel 20 by an equal distance, but only partially toward the height or upper extent of end panels 22, 26.

The bottom panel 20, first end panel 22 and second end panel 26 are maintained in a rigid or stiff condition by means of stiffing boards and brackets as well as by means of a telescoping handle 40. Thus, a telescoping handle 40 is slidably inserted into a first reinforcing channel 42 and a second reinforcing channel or bracket 44 arranged side by side and parallel attached along the bottom panel 20 and extending through the second end panel 26. The channels 42 and 44 are attached to a first support bracket 46 affixed to the bottom panel 20 and to the first end panel 22. The first bracket 46 is L-shaped and formed from a rigid material such as a molded plastic polyethylene or the like. The bracket 46 includes wheel wells 47, each having a wheel 49 mounted therein. In the preferred embodiment two wheels 49 are provided positioned on opposite sides of the bottom panel 20 adjacent the juncture 24 between the first end panel 22 and bottom panel 20.

A second bracket 48 connects with and supports the bottom panel 20 and second end panel 26 and co-acts with the channels or channel members 42 and 44 associated with the telescoping handle 40. The second bracket 48 serves a functional purpose of providing a member for stiffening of the bottom panel 20 and the second end panel 26. Thus, the bracket 48 provides a means for attaching the channels 42 and 44 against or on the bottom panel 20. Further, the bracket 48 provides a means for stiffening the bottom panel 20 and for connecting the bottom panel 20 to the second end panel 26 and a means for stiffening the end panel 26. Thus, the first bracket 46 as well as the second bracket 48, in combination, provide means for stiffening the bottom panel 20 and end panels 22 and 26 and for maintaining those panels in a configuration whereby the end panels 22 and 26 extend in a perpendicular direction upwardly from the bottom panel 20 thereby forming the base for a case or enclosure for the luggage.

A fold over top cover or flap 50 includes an interior face, side or surface 70 and an exterior face, side or surface 72. The flap or cover 50 is attached to integral back side panel of 52 by means of a living hinge 53. Thus, the cover 50 may comprise an extension of the back side panel 52. The cover 50 is sized to fit with or attach to the arcuate margins 30 and 32 and the integral front panel 54 to form an interior space enclosure for the luggage. A zipper 64, which comprises a connection mechanism, fastens the edges 60 and 62 of the cover 50 and the margins 32 and 30 and front panel 54. Thus, a single zipper 64 extends from the living hinge 53 along an enclosure edge 66 to the opposite side of the cover 50. Cover 50 may then be fitted over the interior and over the bottom panel 20 to form the open enclosure or space into which items to may be placed in the luggage.

The luggage may include interior pockets 79 as shown in FIG. 4, as well as an interior mesh wall 77 again as shown in FIG. 4. The cover 50 may have any of a number of configurations and constructions. For example, as shown in FIG. 5, the cover 50 includes the inside surface 70 having a hanging bag or garment bag 80 incorporated therewith or attached thereto. The hanging bag or garment bag 80 includes a top side, section edge 73 through which a hanger 75 in FIG. 10 may be inserted in opening 78. The hanging bag 80 further includes a cover sheet or layer 86 which may be opened. Thus the cover sheet 86 is attached by means of a zipper 81 to the hanging garment bag 80 around at least a part of periphery of sheet 86. The zipper 81 may comprise a single zipper 81 which is enabled to open the flap 86 around its entire periphery while hanging items are inserted through the opening 78. In other words, the sheet 86 fits over the contents and a hanger 75 in the hanging bag 80. Pockets, such as pocket 88, may be included on the outside of the sheet 86.

When forming the cover 50, the garment bag 80 will extend beyond the top edge or section 73 of the cover 50 area. In this circumstance, the garment bag 80 and, more particularly, the top end section 73 of the garment bag 80, will be folded over before the cover 50 is closed. The cover 50 may then be closed and the cover 50 and attached garment bag 80 will remain suspended above the interior of the luggage as a result of the construction of the end panels 22 and 26 in combination with the bottom panel 20 and properly sized cover or flap 50. Thus the top edge section 73 of the garment bag 80 in the vicinity of the hanger opening 78 thus folds over the remainder of the garment bag 80 when the cover or flap 50 is moved to the closed position. A zipper mechanism 60 is provided to effect appropriate closure of the flap 50. The length of the hanging bag 80 is such that hangers 75 enclosed within the bag 80 will facilitate providing a natural fold line when the hanging bag 80 is folded over upon itself. After folding the hanging bag 80 over upon itself, the flap or cover 50 will then be positioned over the bottom panel 20 of the luggage. The zipper connection 60 insures that the top cover 50 and the hanging bag 80, which is affixed thereto, will remain above the bottom panel and above the contents of the luggage. The flap or cover 50, inasmuch as it is formed in an arcuate or curved shape rather than having a number of folds, ensures that the contents of the bag 80 will not become wrinkled or otherwise distressed.

Auxiliary pockets 88 and 90 are provided on sheet 82. Pocket 88 includes a zipper opening mechanism 92. Pocket 90 includes a zipper opening mechanism 94. Each of the pockets 88 and 90 are positioned on the outside of sheet 82 of the garment bag 80.

Referring now to FIG. 6 there is depicted another embodiment of the invention. With the embodiment of FIG. 6 the cover or flap 50 includes a packing assembly 97 which is totally removable from the inside face of the flap 50. The packaging assembly 97 has a generally rectangular shape or profile and includes a zipper attachment 98 which extends around the periphery or circumference of the assembly 97 to attach or permit removal of the assembly 97. The package assembly 97 is preferably sized to fit within or be congruent with the profile of the flap 50. In other words, the area of the flap 50 may exceed the area of the assembly 97. In this manner, when the flap or cover 50 is folded over the end panels 22 and 26 and attached from the integral back panel to the integral front panel, the assembly 97 will be suspended over the enclosure within the bag or luggage.

The bag or luggage may thus include an assembly 97 which is totally removable. For example, a shoe storage kit could be separately removable from the luggage item. The assembly 96 may thus include a pouch 100 and shoe sleeves 102 and 104 by way of example. The pouch 100 has an access zipper 106 and a clear or plastic section 108 to reveal the contents of the pouch 100. An additional pouch or storage section 110 is provided for the assembly 97. The entire assembly 97 may be removed from the bag and optionally may include a hanging strap or hanger 112.

Figure 7:
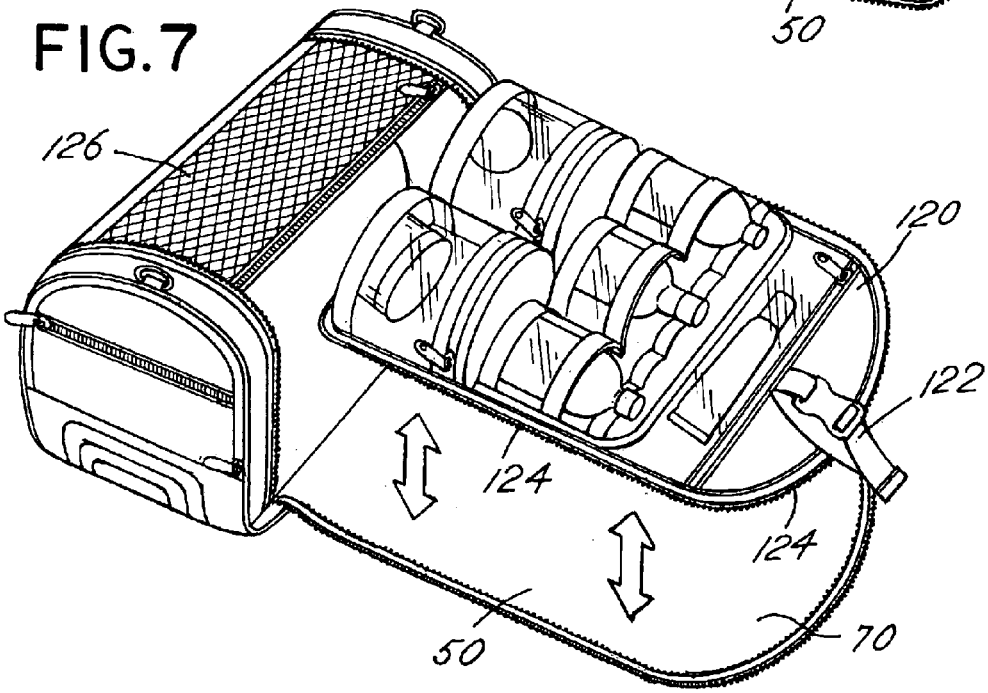
FIG. 7 is an isometric view of another alternative embodiment of the invention with the top cover flap in the open position.

FIG. 7 depicts yet another alternative construction. In FIG. 7 a package assembly 120 is provided for cosmetics or toiletries, for example. The assembly 120 includes a hanging strap 122. A connection zipper 124 is provided to attach or detach the assembly 120 to the cover or flap of 50. Another feature of the embodiment of FIG. 7 is the inclusion of a mesh panel 126 positioned along the integral front panel 54 of the luggage or bag. The mesh panel 126 is an optional feature.

FIG. 8 illustrates a further embodiment of the invention. In FIG. 8 cover 50 includes an integrated pouch or pockets, such as pocket 130 and pocket 132. Again, folding the cover or flap 50 over the end panels of 22 and 26 enables the cover 50 to be suspended above the contents of the luggage, for example, the shirts, 134, to thereby prevent interference with and wrinkling of the contents.

FIGS. 9 and 10 illustrate a tote bag which incorporates the features of the invention. The tote bag includes a flap or cover 140 which has the same construction as depicted with respect to the previously described embodiments. A carry strap 142 is provided attached to opposite end panels 144 and 146. An optional top side handle 148 is also included. Handles and straps may be incorporated with any of the embodiments. Note again that a single zipper 150 connects the flap 140 to the semi-rigid components comprising the bag or enclosure.

As depicted in FIG. 10, the flap 140 may include a garment bag, hanging bag or wardrobe 160 affixed to the inside thereof. The hanging bag 160 may be folded over upon itself so that it lies within the profile of the flap or cover 140. The folded hanging bag 160 and cover 140 may then be closed up in the manner shown in FIG. 9 over the enclosure or inside contents of the tote bag depicted in FIGS. 9 and 10.

Various other alternative constructions are possible within the subject matter of the invention. Important features, however, include the semi-rigid or rigid bottom panel 20 and end panels 22 and 26 in combination with the telescoping handle 40 and wheels 49 and further in combination with the flap or cover 50 and packing features including on the inside face thereof, such as any one of a number of optional pouches and the like. Therefore, the invention is limited only by the following claims and equivalents.

What is claimed is:

1. Luggage having a back side, a front side, a top side and a fold over top flap, said luggage comprising, in combination:

(a) a lower bag section including:

(i) a generally rectangular bottom panel with a first side edge, a second, opposite side edge, a front edge and a back edge, said bottom panel being generally rigid;

(ii) a first end panel attached to the first side edge of the bottom panel and extending generally upwardly therefrom, said first end panel including an arcuate upper section and an arcuate top edge margin extending inwardly from said first end panel;

(iii) a second end panel attached to the second, opposite side edge of the bottom panel, said second end panel generally parallel to and spaced from the first end panel, said second end panel congruent in size and shape with the first end panel and extending generally upwardly from the bottom panel said second end panel including an arcuate upper section and an arcuate top edge margin extending inwardly from said second end panel toward the first end panel;

(iv) an integral back side panel extending from the back side edge of the bottom panel partially upwardly and connected to the top edge margins of the first and second end panels, said back side panel having a top edge;

(v) an integral front side panel extending from the front side edge of the bottom panel partially upwardly toward and connected to the top margins of the first and second end panels and having a top edge, said bottom panel, first and second end panels, front panel and back panel forming an open top for the luggage, said open top comprising a majority of the back side of the luggage, a majority of the front side of the luggage and the top side of the luggage; and (b) a flexible, foldable top cover flap hingedly attached to the top edge of the back side panel margin and detachably connected to the margins of the first and second end panels and the front panel by a continuous connection mechanism, said margins of said back panel, end panels and front panel comprising a single continuous margin for attachment of the cover flap;

said top cover flap extending over the open top side of the luggage from a majority of the distance measured between the top edge margins of the first and second end panels and the bottom panel, said top cover flap including an inside with a removable pouch fastened thereto, said removable pouch and top cover flap forming a cover to define a free interior space of the luggage when the cover flap is closed, said cover flap being flexible and foldable between a first position enclosing the luggage and a second position opening the luggage with the cover flap pivotal about the back side top edge.

2. Luggage having a back side, a front side, a top side and a fold over top flap comprising in combination:

(a) a lower bag section including:

(i) a generally rectangular bottom panel with a first side edge, a second opposite side edge, a front edge and a back edge, said bottom panel being generally rigid;

(ii) a first end panel attached to the first side edge of the bottom panel and extending generally upwardly therefrom, said first end panel including an arcuate upper section and an arcuate top edge margin extending inwardly from said first end panel;

(iii) a second end panel attached to the second, opposite side edge of the bottom panel, said second end panel generally parallel to and spaced from the first end panel, said second end panel congruent in size and shape with the first end panel and extending generally upwardly from the bottom panel, said second end panel including an arcuate upper section and an arcuate top edge margin extending inwardly from said second end panel toward the first end panel;

(iv) an integral back side panel extending from the back side edge of the bottom panel partially upwardly and connected to the top margins of the first and second end panels, said back side panel having a top edge;

(v) an integral front side panel extending from the front side edge of the bottom panel partially upwardly and connected to the top margins of the first and second end panels, said front side panel having a top edge; and (b) a flexible, foldable top cover flap hingedly attached to the integral back side panel top edge and detachably connected to the margins of the first and second end panels and to the integral front side panel by a continuous connection mechanism, said top margins of said end panels and front side panel comprising a single continuous margin for attachment of the cover flap, said top cover flap extending over the open top and sides of the luggage and extending a majority of the distance measured between the top edge margins of the first and second panels and the bottom panel; and said top cover flap including an inside, a top edge attachable to the front side panel top edge, and a hanging bag removably attached to the inside of the flap, said hanging bag including a top hanger side and opposite bottom side, said hanger side aligned with the top edge of the cover flap, said bag including a hanger mechanism for hanging said hanging bag.

3. Luggage of claim 1 or claim 2 further including a telescoping handle extending longitudinally between the first end panel and second end panel, said handle attached to the bottom panel and extendable outwardly from the second end panel and further including wheels at the juncture of the first end panel and bottom panel.

4. Luggage of claim 1 or claim 2 wherein the connection mechanism comprises a zipper.

5. Luggage of claim 1 wherein the pouch includes an outside face with pockets on the outside face of the pouch.

6. Luggage of claim 1 wherein the pouch includes an outside face layer and a top margin section, said top margin section including a banger opening, said outside face layer detachably attached to the pouch and the top margin section by a single continuous connection mechanism.

7. Luggage having a back side, a front side, a toy side and a fold over top flap comprising in combination:

(a) a lower bag section including:

(i) a generally rectangular bottom panel with a first side edge, a second opposite side edge, a front edge and a back edge, said bottom panel being generally rigid;

(ii) a first end panel attached to the first side edge of the bottom panel and extending generally upwardly therefrom, said first end panel including an arcuate upper section and an arcuate top edge margin extending inwardly from the first end panel;

(iii) a second end panel attached to the second, opposite side edge of the bottom panel, said second end panel generally parallel to and spaced from the first end panel, said second end panel congruent in size and shape with the first end panel and extending generally upwardly from the bottom panel, said second end panel including an arcuate upper section and an arcuate top edge margin extending inwardly toward the first end panel;

(iv) an integral back side panel extending from the back side edge of the bottom panel partially upwardly toward the top margins of the first and second end panels and having a tap edge;

(v) an integral front side panel extending from the front side edge of the bottom panel partially upwardly toward the top margins of the first and second end panels and having a top edge, said bottom panel, first and second end panels, front panel and back panel forming an open top comprised of a majority of the back side and front side of the luggage and the top side of the luggage; and (b) a flexible, foldable top cover flap hingedly attached to the integral back side panel top edge and detachably connected to the margins of the first and second end panels and the top edge of the front panel by a continuous connection mechanism, said margins of said first and second end panels and said front panel comprising a single continuous margin for attachment of the cover flap;

said top cover flap including an inside and a top edge with a hanging bag affixed to the inside, said hanging bag including a top hanger side and an opposite bottom side, said top hanger side including an opening for a hanger, said top hanger side aligned with the cover flap and extending beyond of the cover flap, whereby the hanging bag may be folded against the top cover inside when the top cover is closed and retained to define a free space within the interior of the luggage, said top cover flap extending over the open to and sides of the luggage and extending a majority of the distance between the top edge margins of the first and second end panels and the bottom panel.

* * * * *